US009188893B2

(12) United States Patent
Goan et al.

(10) Patent No.: US 9,188,893 B2
(45) Date of Patent: Nov. 17, 2015

(54) TONER FOR DEVELOPING ELECTROSTATIC IMAGE

(71) Applicant: Konica Minolta, Inc., Tokyo (JP)

(72) Inventors: Kazuyoshi Goan, Tokyo (JP); Mikio Kouyama, Tokyo (JP); Hajime Tadokoro, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/170,936

(22) Filed: Feb. 3, 2014

(65) Prior Publication Data

US 2014/0228532 A1 Aug. 14, 2014

(30) Foreign Application Priority Data

Feb. 14, 2013 (JP) ..... 2013-026357

(51) Int. Cl.
*G03G 9/087* (2006.01)

(52) U.S. Cl.
CPC ..... *G03G 9/08726* (2013.01); *G03G 9/08711* (2013.01); *G03G 9/08733* (2013.01)

(58) Field of Classification Search
CPC ..... G03G 9/08733; G03G 9/08726; G03G 9/08711
USPC ..... 526/303.1, 304, 305
See application file for complete search history.

(56) References Cited

U.S. PATENT DOCUMENTS

2011/0247516 A1* 10/2011 Loccufier et al. ..... 101/483

FOREIGN PATENT DOCUMENTS

| | | | | |
|---|---|---|---|---|
| JP | 2002-287410 | A | | 10/2002 |
| JP | 2003-330227 | A | | 11/2003 |
| JP | 2004-191618 | A | | 7/2004 |
| JP | 2004-271638 | A | | 9/2004 |
| JP | 2007245648 | A | * | 9/2007 |

* cited by examiner

*Primary Examiner* — Ling Choi
*Assistant Examiner* — David L Miller
(74) *Attorney, Agent, or Firm* — Lucas & Mercanti, LLP

(57) ABSTRACT

Provided is a toner for developing an electrostatic image wherein an environment variation difference in a charging ability can be controlled to be small while having sufficient low temperature fixability. The toner includes toner particles that contain at least a binder resin. The binder resin contains a polymer prepared by polymerizing a polymerizable monomer represented by a following general formula (1).

In the general formula (1), $R^1$ and $R^2$ each independently represent a hydrogen atom, or a substituted or unsubstituted alkyl group having 1 to 2 carbon atoms; and $R^3$ represents a hydrogen atom, or a substituted or unsubstituted alkyl group having 1 to 4 carbon atoms. X represents an oxygen atom or a single bond; Y represents a substituted or unsubstituted alkylene group having 1 to 4 carbon atoms, or a single bond; and Ar represents a substituted or unsubstituted aryl group.

General Formula (1)

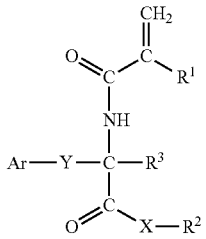

6 Claims, No Drawings

TONER FOR DEVELOPING ELECTROSTATIC IMAGE

CROSS REFERENCE TO RELATED APPLICATION

This Application claims the priority of Japanese Patent Application No. 2013-026357 filed on Feb. 14, 2013, which is incorporated by reference herein.

TECHNICAL FIELD

The present invention relates to a toner for developing an electrostatic image (hereinafter, also merely referred to as a "toner") used in image formation of an electrophotographic system.

BACKGROUND ART

Under the recent circumstances where energy saving is promoted, in the electrophotographic technical field, there has been an attempt to reduce the energy (that is, to achieve low temperature fixing) in a fixing device for the purpose of a decrease in power consumption and an increase in printing speed.

However, as such low temperature fixing is promoted, the thermal stability of a toner used has been reduced. Accordingly, there has been a problem in that heat-resistant storage properties cannot be sufficiently obtained during storage and transportation. Also, there has been another problem in that toner components such as colorants or parting agents are exposed on the surface of a toner, and therefore stable charging properties cannot be maintained for a long period of time.

A known solution to the above-described problems is to use a toner having a structure configured by covering a toner surface with a resin, a so-called core-shell structure (for example, see Patent Literatures 1 and 2).

In general, a toner produced by an emulsion association method includes associated particles obtained by aggregating and fusing resin fine particles and fine particles of a toner component such as a colorant using an aggregating agent such as metal salts. In this case, a large amount of an aggregating agent is required. Therefore, particularly when the resin fine particles include a monomer containing a polar group such as a carboxylic acid group, metal salts, which are derived from the aggregating agent, attached to or contained in the associated particles are hardly removed completely by a washing treatment. Furthermore, since the metal salts derived from an aggregating agent have high hygroscopicity, a toner obtained has also high hygroscopicity. As a result, when image formation is performed in a high temperature and high humidity environment, the charging ability of a toner is lowered compared with the case when performed in a low temperature and low humidity environment.

When a core-shell structure is formed in such an emulsion association-type toner, it is desirable that the toner surface is covered with a resin without using an aggregating agent as far as possible.

For example, Patent Literatures 3 and 4 disclose a technology of defining the content of a divalent or trivalent metal element and the content of a polyvalent metal element in view of an influence of metal salts. However, the improvement effect is not sufficient. Thus, further improvement, including a resin, is being required with respect to low temperature fixability and controlled environment variation difference in a charging ability.

CITATION LIST

Patent Literature

Patent Literature 1: Japanese Patent Application Laid-Open No. 2004-191618

Patent Literature 2: Japanese Patent Application Laid-Open No. 2004-271638

Patent Literature 3: Japanese Patent No. 3937738

Patent Literature 4: Japanese Patent No. 4158506

SUMMARY OF INVENTION

Technical Problem

The present invention has been made on the foregoing circumstances and has as its object the provision of a toner for developing an electrostatic image wherein an environment variation difference in a charging ability can be controlled to be small while having sufficient low temperature fixability.

Solution to Problem

To achieve at least one of the above-mentioned objects, the toner for developing an electrostatic image reflecting one aspect of the present invention includes toner particles containing at least a binder resin, wherein the binder resin contains a polymer prepared by polymerizing a polymerizable monomer represented by a following general formula (1).

[Chemical Formula 1]

General Formula (1)

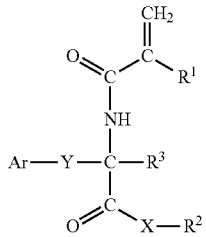

In the general formula (1), $R^1$ and $R^2$ each independently represent a hydrogen atom, or a substituted or unsubstituted alkyl group having 1 to 2 carbon atoms; and $R^3$ represents a hydrogen atom, or a substituted or unsubstituted alkyl group having 1 to 4 carbon atoms. X represents an oxygen atom or a single bond; Y represents a substituted or unsubstituted alkylene group having 1 to 4 carbon atoms, or a single bond; and Ar represents a substituted or unsubstituted aryl group.

In the above-mentioned toner for developing an electrostatic image, Ar in the general formula (1) is preferably a group represented by a following general formula (2).

[Chemical Formula 2]

General Formula 2

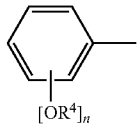

In the general formula (2), $R^4$ represents a hydrogen atom, or a substituted or unsubstituted alkyl group having 1 to 4 carbon atoms. n is an integer of 0 to 3. When n is an integer of 2 or 3, a plurality of $R^4$s may be the same or different.

In the above-mentioned toner for developing an electrostatic image, $R^4$ in the general formula (2) is preferably a hydrogen atom.

In the above-mentioned toner for developing an electrostatic image, the polymer is preferably prepared by copolymerizing the polymerizable monomer represented by the general formula (1) and (meth)acrylic ester.

In the above-mentioned toner for developing an electrostatic image, the polymer is preferably prepared by copolymerizing the polymerizable monomer represented by the general formula (1), (meth)acrylic ester, and styrene.

In the above-mentioned toner for developing an electrostatic image, a content of the polymerizable monomer represented by the general formula (1) is preferably 27 to 70% by mass per a total amount of monomers for forming the polymer.

Advantageous Effects of Invention

According to the above-mentioned toner for developing an electrostatic image, the binder resin contains the polymer (hereinafter, also referred to as a "specific polymer") prepared by polymerizing the polymerizable monomer (hereinafter, also referred to as a "specific monomer") represented by the general formula (1). Accordingly, an environment variation difference in a charging ability can be controlled to be small while having sufficient low temperature fixability.

DESCRIPTION OF EMBODIMENTS

The present invention will be described in detail below.

Toner:

The toner according to the present invention includes toner particles containing a binder resin that includes a specific polymer prepared by polymerizing a specific monomer. The toner particle can further optionally include a colorant, magnetic powder, a parting agent, a charge control agent, and the like. Also, external additives such as a fluidizer and a cleaning auxiliary can be added to the toner particle.

Binder Resin:

Specific Polymer:

The specific polymer that can be configured as the binder resin in the toner according to the present invention is formed using at least the specific monomer as a monomer.

In the present invention, the specific polymer configured as the binder resin is formed using the polymerizable monomer represented by the general formula (1) above. Accordingly, the polymerizable monomer represented by the general formula (1) has a phenylalanine backbone. This phenylalanine backbone has a property of showing hydrophilicity in a low temperature and low humidity environment and hydrophobicity in a high temperature and high humidity environment. Therefore, even when an environmental atmosphere is changed, a certain moisture state can be maintained to some extent in the vicinity of a toner surface. As a result, an environment variation difference in a charging ability can be controlled to be small, and therefore a high quality image can be stably formed.

In the general formula (1) representing the specific monomer, $R^1$ and $R^2$ each independently represent a hydrogen atom, or a substituted or unsubstituted alkyl group having 1 to 2 carbon atoms. As examples of a group with which a hydrogen atom(s) of this alkyl group having 1 to 2 carbon atoms can be substituted, may be mentioned an aryl group, a halogen atom, and an alkoxyl group. $R^1$ and $R^2$ each preferably represent a methyl group.

$R^3$ represents a hydrogen atom, or a substituted or unsubstituted alkyl group having 1 to 4 carbon atoms. As examples of a group with which a hydrogen atom(s) of this alkyl group having 1 to 4 carbon atoms can be substituted, may be mentioned an aryl group, a halogen atom, and an alkoxyl group. $R^3$ is preferably a hydrogen atom or a methyl group.

X represents an oxygen atom or a single bond.

Y represents a substituted or unsubstituted alkylene group having 1 to 4 carbon atoms with a linear or branched chain, or a single bond. As examples of a group with which a hydrogen atom(s) of this alkylene group having 1 to 4 carbon atoms can be substituted, may be mentioned an aryl group, a halogen atom, and an alkoxyl group. Y is preferably a methylene group.

Ar represents a substituted or unsubstituted aryl group. As examples of the aryl group, may be mentioned a phenyl group, a benzyl group, and a tolyl group. Also, as examples of a group with which a hydrogen atom(s) of the aryl group can be substituted, may be mentioned a hydroxyl group and a methoxy group. Ar is preferably a group represented by the general formula (2) above from the viewpoint of polymerization reaction properties. In the general formula (2), $R^4$ represents a hydrogen atom, or a substituted or unsubstituted alkyl group having 1 to 4 carbon atoms with a linear or branched chain. As an example of a group with which a hydrogen atom(s) of this alkylene group having 1 to 4 carbon atoms can be substituted, may be mentioned an aryl group. When $R^4$ exists plurally, the $R^4$s may be the same or different. $R^4$ is particularly preferably a hydrogen atom. When $R^4$ exists plurally, at least one $R^4$ is preferably a hydrogen atom. When $R^4$ is a hydrogen atom, that is, when a hydroxyl group is introduced at a terminal of the phenylalanine backbone, the chemical affinity of paper to fiber can be increased. As a result, adhesion to paper is increased, and therefore, low temperature fixability is improved. n is an integer of 0 to 3, preferably 1 to 2.

As examples of the specific monomer, may be mentioned compounds (1) to (11) below.

[Chemical Formula 3]

Compound (1)

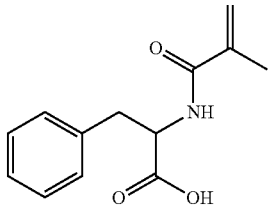

Compound (2)

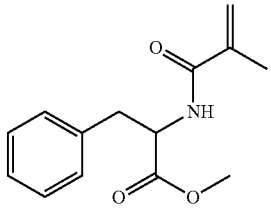

-continued

Compound (3)

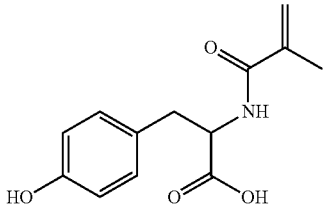

Compound (4)

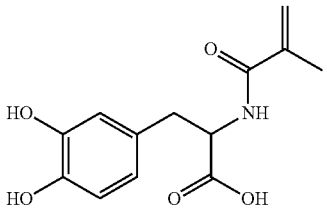

[Chemical Formula 4]

Compound (5)

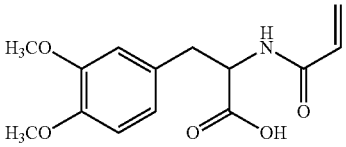

Compound (6)

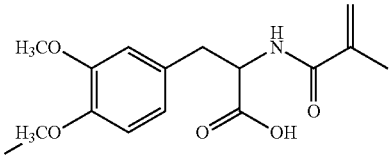

Compound (7)

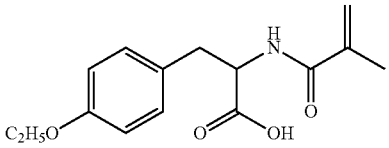

Compound (8)

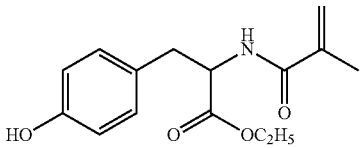

Compound (9)

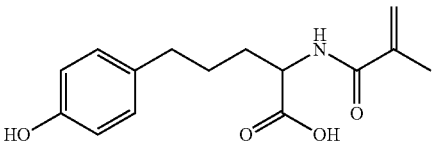

Compound (10)

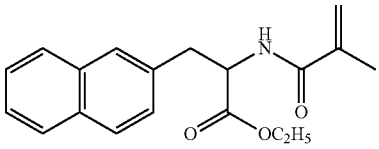

-continued

Compound (11)

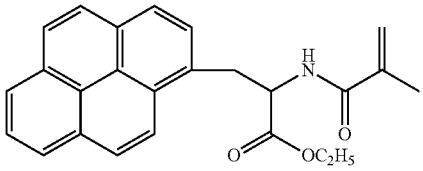

The specific monomers as described above may be used singly or in any combination thereof.

The specific monomers can be obtained from, for example, amino acid or amino acid ester and methacryloyl acid or a derivative thereof, by an amide bond synthesis method such as an active ester method, a mixed acid anhydride method, an azide method, an acid chloride method, a symmetric acid anhydride method, a DCC method, a DCC-additive method and a carbonylimidazole method. Especially, an acid chloride method is preferably adopted.

The amino acid may be an L-form, a D-form, or a mixture thereof (a racemic body). From the viewpoint of biodegradability, an L-form is preferred.

A reaction between amino acid or amino acid ester and methacryloyl acid or a derivative thereof is performed in an aqueous medium; a non-aqueous medium including halogen-based hydrocarbon solvents such as methylene and chloroform and aprotic polar solvents such as THF, acetonitrile, and DMF; or a mixed solvent thereof, at approximately −20 to 40° C. for approximately 1 to 24 hours. Also, during the reaction, it is preferred that an equivalent amount of a base such as triethylamine, t-BuOK, $K_2CO_3$, $Na_2CO_3$, and NaOH is usually added as a catalyst. As a specific example of the above-described reaction, a reaction between phenylalanine and methacryloyl chloride is shown in a following reaction formula (1). Here, in the reaction formula (1), $R^1$ has the same meaning as $R^1$ in the general formula (1).

Reaction Formula (1)

[Chemical Formula 5]

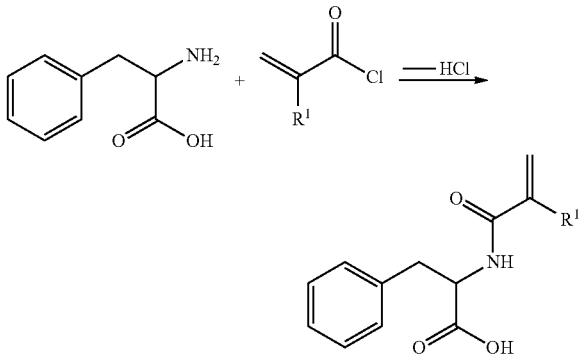

The specific polymer according to the present invention is prepared by polymerizing at least the specific monomer. A polymerization method that can be adopted in such a polymerization is not particularly limited, and a publicly known method can be appropriately adopted. As examples of such a publicly known polymerization method, may be mentioned an emulsion polymerization method, a soap-free emulsion polymerization method, a solution polymerization method, a polymerization method using only a monomer without using a solvent, a suspension polymerization method, a radical polymerization method, an anionic polymerization method, and a photopolymerization method. Also, as a polymerization initiator (2,2'-azobisisobutyronitrile, benzoyl peroxide, ammonium persulfate, n-butyl lithium and the like) and a solvent (xylene, toluene, isopropanol, water and the like), which are used in the above-described polymerization method, publicly known polymerization initiators and solvents may be appropriately selected for use in polymerization.

Also, the condition in such a polymerization reaction can be appropriately set according to an adopted polymerization method, and is not particularly limited. For example, adopted conditions may include a contained amount of the polymerization initiator of about 0.01 to 10 mol % with respect to a monomer, a monomer concentration of about 10 to 100% by mass, an atmosphere of an inert gas such as nitrogen, a reaction temperature of about −100 to 150° C., and a reaction time of about 1 to 48 hours.

In the present invention, the specific polymer may be a homopolymer formed of only the specific monomer. However, a copolymer formed of the specific monomer and another polymerizable monomer is preferred.

As examples of another polymerizable monomer that can be copolymerized with the specific monomer, may be mentioned a (meth)acrylic ester-based monomer, a styrene-based monomer, and a polymerizable monomer having an ionic dissociation group. Especially, as another polymerizable monomer, a (meth)acrylic ester-based monomer and a styrene-based monomer are preferably used in terms of stabilization of the polymerization reaction.

As specific examples of the (meth)acrylic ester-based monomer, may be mentioned acrylate derivatives such as methyl acrylate, ethyl acrylate, n-butyl acrylate, isopropyl acrylate, isobutyl acrylate, t-butyl acrylate, n-octyl acrylate, 2-ethylhexyl acrylate, cyclohexyl acrylate, stearyl acrylate, lauryl acrylate, phenyl acrylate, dimethylaminoethyl acrylate, and diethylamino ethyl acrylate; and methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, cyclohexyl methacrylate, stearyl methacrylate, lauryl methacrylate, phenyl methacrylate, dimethyl amino ethyl methacrylate, and diethylamino ethyl methacrylate. Among these, n-butyl acrylate and 2-ethyl hexyl acrylate are preferably need. These may be used either singly or in any combination thereof.

As specific examples of the styrene-based monomer, may be mentioned styrene or styrene derivatives such as styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, and p-n-dodecyl styrene. These may be used either singly or in any combination thereof.

The ionic dissociation group refers to a substitutent such as a carboxyl group, a sulfonic acid group, and a phosphoric acid group. As specific examples of the polymerizable monomer having an ionic dissociation group, may be mentioned acrylic acid, methacrylic acid, maleic acid, itaconic acid, fumaric acid, styrene sulfonic acid, and acrylamide propyl sulfonic acid. Among these, acrylic acid and methacrylic acid are preferably used. These may be used either singly or in any combination thereof.

The content (copolymerization ratio) of the specific monomer is preferably 27 to 70% by mass, more preferably 30 to 65% by mass, per a total amount of monomers for forming the specific polymer.

When the content of the specific monomer falls within the above-described range, an environment variation difference in a charging ability can be controlled to be small while having sufficient low temperature fixability.

The glass transition temperature of the specific polymer is preferably 40 to 80° C., more preferably 40 to 65° C.

When the glass transition temperature of the specific polymer falls within the above-described range, heat-resistant storage properties can be sufficiently obtained.

In the present invention, the glass transition temperature of the specific polymer is measured using a differential scanning calorimeter "DSC-7" (manufactured by PerkinElmer, Inc.).

Specifically, 4.5 mg of a measurement sample (the specific polymer) is sealed in an aluminum pan "KIT No. 0219-0041", and the pan is set in a sample holder of the "DSC-7". An empty aluminum pan was used for reference measurement. A measurement was performed under the condition of a measurement temperature of 0° C. to 200° C., a temperature rise rate of 10° C./min, a temperature drop rate of 10° C./min, and Heat-cool-Heat temperature control. An analysis was performed based on the data of the 2nd. Heat. As to the glass transition temperature, an extension line of a base line before rising of the first endothermic peak and a tangent line indicating a maximum inclination in the range from a rising part to a peak top of the first endothermic peak are drawn. Then, an intersection point therebetween is shown as a glass transition temperature. In this case, during the 1st. Heat temperature rise, 200° C. was maintained for 5 minutes.

In the specific polymer, the peak molecular weight obtained by a molecular weight distribution based on a styrene equivalent molecular weight measured by gel permeation chromatography (GPC) is preferably 1,500 to 60,000, more preferably 3,000 to 40,000. Here, the peak molecular weight refers to a molecular weight corresponding to an elution time of a peak top in a molecular weight distribution. When a plurality of peak tops exist in a molecular weight distribution, the peak molecular weight refers to a molecular weight corresponding to an elution time at a peak top having the largest peak area ratio.

In the present invention, the peak molecular weight of the specific polymer is measured by gel permeation chromatography (GPC).

Specifically, using an apparatus "HLC-8220" (manufactured by Tosoh Corporation) and a column "TSK guard column+TSK gel Super HZ-M 3 in series" (manufactured by Tosoh Corporation), tetrahydrofuran (THF) is flown as a carrier solvent at a flow rate of 0.2 ml/min while maintaining the column temperature at 40° C. Under the dissolution condition of treating a measurement sample using an ultrasonic dispersion machine at room temperature for 5 minutes, the measurement sample (a specific polymer) is dissolved in tetrahydrofuran so that the solution has a concentration of 1 mg/ml. Next, a treatment is performed using a membrane filter having a pore size of 0.2 μm to obtain a sample solution. Then, 10 μl of this sample solution is injected in the apparatus together with the above-described carrier solvent, and detection is performed using a refractive index detector (an RI detector). The molecular weight distribution of the measurement sample is calculated using a calibration curve measured with monodispersed polystyrene standard particles. For measuring the calibration curve, 10 different polystyrenes were used.

The binder resin that constitutes the toner according to the present invention may be configured by only the specific polymer, or may be a mixture of the specific polymer and another resin.

When the binder resin is a mixture with another resin, the content of another resin is preferably 10 to 40% by mass in the binder resin.

Colorant:

When the toner particle according to the present invention is configured to contain a colorant, commonly known dyes and pigments can be used as the colorant.

As examples of the colorant for obtaining a black toner, may be mentioned carbon black, a magnetic body, and iron-titanium composite oxide black. As examples of the carbon black, may be mentioned channel black, furnace black, acetylene black, thermal black, and lamp black. Also, as examples of the magnetic body, may be mentioned ferrite and magnetite.

As the colorant for obtaining a yellow toner, may be mentioned dyes such as C. I. Solvent Yellow 19, 44, 77, 79, 81, 82, 93, 98, 103, 104, 112, and 162; and pigments such as C. I. Pigment Yellow 14, 17, 74, 93, 94, 138, 155, 180, and 185.

As the colorant for obtaining a magenta toner, may be mentioned dyes such as C. I. Solvent Red 1, 49, 52, 58, 63, 111, and 122; and pigments such as C. I. Pigment Red 5, 48:1, 53:1, 57:1, 122, 139, 144, 149, 166, 177, 178, and 222.

As the colorant for obtaining a cyan toner, may be mentioned dyes such as C. I. Solvent Blue 25, 36, 60, 70, 93, and 95; and pigments such as C. I. Pigment Blue 1, 7, 15, 60, 62, 66, and 76.

The colorant for obtaining each color toner may be used either singly or in any combination thereof for each color.

The content of a colorant is preferably 0.5 to 20% by mass, more preferably 2 to 10% by mass, in the toner particle.

Magnetic Powder:

Also, when the toner particle according to the present invention is configured to contain magnetic powder, as examples of the magnetic powder, may be used magnetite, γ-hematite, or various ferrites.

The content of magnetic powder is preferably 10 to 500% by mass, more preferably 20 to 200% by mass, in the toner particle.

Parting Agent:

Also, when the toner particle according to the present invention is configured to contain a parting agent, no particular limitation should be made, and commonly known waxes can be used as the parting agent. As examples of the wax, may be mentioned polyolefin such as low molecular weight polypropylene and polyethylene or oxidized low molecular weight polypropylene and polyethylene, paraffin, and synthesized ester waxes. Especially, synthesized ester waxes have a low melting point and a low viscosity, and therefore are preferably used. As the synthesized ester waxes, behenyl behenate, glycerin tribehenate, pentaerythritol tetrabehenate and the like are particularly preferably used.

The content of a parting agent is preferably 1 to 30% by mass, more preferably 3 to 15% by mass in the toner particle.

Charge Control Agent:

Also, when the toner particle according to the present invention is configured to contain a charge control agent, the charge control agent is not particularly limited as long as the charge control agent is a substance that can provide a positive or negative charge by a friction charge, and colorless. Various publicly known positively charged charge control agents and negatively charged charge control agents can be employed.

The content of the charge control agent is preferably 0.01 to 30% by mass, more preferably 0.1 to 10% by mass in the toner particle.

The glass transition temperature of the toner according to the present invention is preferably 40 to 80° C., more preferably 40 to 70° C.

When the glass transition temperature of the toner according to the present invention falls within the above-described range, heat-resistant storage properties can be sufficiently obtained.

In the present invention, the glass transition temperature of a toner can be measured using a differential scanning calorimeter "DSC-7" (manufactured by PerkinElmer, Inc.).

Specifically, 4.5 mg of a measurement sample (a toner) is sealed in an aluminum pan "KIT No. 0219-0041," and the pan is set in a sample holder of "DSC-7." An empty aluminum pan was used for reference measurement. A measurement was performed under the condition of a measurement temperature of 0° C. to 200° C., a temperature rise rate of 10° C./min, a temperature drop rate of 10° C./min, and Heat-cool-Heat temperature control. An analysis was performed based on the data of the 2nd. Heat. As to the glass transition temperature, an extension line of a base line before rising of the first endothermic peak and a tangent line indicating a maximum inclination in the range from a rising part to a peak top of the first endothermic peak are drawn. Then, an intersection point therebetween is shown as a glass transition temperature. In this case, during the 1st. Heat temperature rise, 200° C. was maintained for 5 minutes.

The softening point of the toner according to the present invention is preferably 80 to 110° C., more preferably 90 to 105° C.

In the present invention, the softening point of the toner is measured as follows.

First, 1.1 g of a measurement sample (a toner) was put in a petri dish and flattened in set environment of 20° C. and 50% RH. Then, the sample was left to stand for 12 hours or longer. Thereafter, the sample was pressurized for 30 seconds with a force of 3820 kg/cm$^2$ using a molding machine "SSP-10A" (manufactured by Shimadzu Corporation) to prepare a column-shaped molded sample having a diameter of 1 cm. Next, after preheating was completed, the molded sample was extruded through a hole (1 mm in diameter×1 mm) of a column-shaped die, using a piston having a diameter of 1 cm, under the condition of a load of 196 N (20 kgf), an onset temperature of 60° C., a preheating time of 300 seconds and a temperature rise rate of 6° C./min, by a flow tester "CFT-500D" (manufactured by Shimadzu Corporation), in an environment of 24° C. and 50% RH. An offset method temperature $T_{offset}$ measured by setting the offset value at 5 mm in a melting temperature measurement method of a temperature rise method is defined as a softening point.

Average Particle Size of Toner:

The average particle size of the toner according to the present invention is, for example, preferably 4 to 10 μm, more preferably 6 to 9 μm, in terms of a volume-based median diameter.

When the volume-based median diameter falls within the above-described range, transfer efficiency is increased to improve a half-tone image. Thus, an image quality of a fine line, a dot and the like is improved.

The volume-based median diameter of the toner in the present invention is measured and calculated using a measuring device in which a computer system (manufactured by Beckman Coulter, Inc.) installed with a data processing software "Software V3.51" is connected to "Coulter Multisizer TA-III" (manufactured by Beckman Coulter, Inc.).

Specifically, 0.02 g of a measurement sample (a toner) was added in 20 mL of a surfactant solution, and the mixture was mixed thoroughly. The surfactant solution was obtained by, for example, diluting a neutral detergent containing a surfactant component 10 times with pure water for the purpose of dispersion of toner particles. Then, an ultrasonic dispersion was performed for one minute to prepare a toner dispersion liquid. The toner dispersion liquid was poured using a pipet in a beaker containing "ISOTON II" (manufactured by Beckman Coulter, Inc.) therein placed in a sample stand until the concentration displayed in the measuring device reaches 8%.

Here, when the concentration falls within this range, a reproducible measurement value can be obtained. Then, in the measuring device, a frequency value is calculated under the condition of a measurement particle count number of 25,000, an aperture diameter of 50 μm, and a measurement range of 1 to 30 μm divided into 256 portions. A particle size corresponding to 50% from the largest volume-integrated fraction is defined as a volume-based median diameter.

Average Roundness of Toner:

In the toner according to the present invention, the toner particles constituting the toner have an average roundness of preferably 0.950 to 0.980 from the viewpoint of improvement in transfer efficiency.

In the present invention, the average roundness of a toner is measured using "FPIA-2100" (manufactured by Sysmex Corporation). Specifically, a measurement sample (a toner) is mixed thoroughly in an aqueous solution containing a surfactant. The mixture is subjected to an ultrasonic dispersion treatment for one minute for dispersion. Thereafter, using "FPIA-2100" (manufactured by Sysmex Corporation), photographing is performed under the measurement condition of an HPF (high magnification photographing) mode and at a proper concentration of an HPF detection number of 3,000 to 10,000. The roundness of each toner particle is calculated according to a following formula (T). The roundness of each toner particle is added to each other, and the obtained value is divided by a total number of toner particles, thereby calculating an average roundness. When the HPF detection number falls within the above-described range, reproducibility can be obtained.

Roundness=(Perimeter of circle having the same projected area as particle image)/(Perimeter of particle projection image) Formula (T)

According to the toner described above, the binder resin contains the specific polymer prepared by polymerizing the specific monomer. Accordingly, an environment variation difference in a charging ability can be controlled to be small while having sufficient low temperature fixability.

Also, in the toner described above, the specific monomer is a monomer derived from a biomass material, that is amino acid. Thus, the specific polymer can be obtained from a plaint-derived material. Therefore, an environmental load can be suppressed to a low level.

Production Method of Toner:

The production method of the toner according to the present invention is not particularly limited. Examples thereof may include a kneading and pulverizing method, a suspension polymerization method, an emulsion aggregation method, an emulsion polymerization aggregation method, a mini-emulsion polymerization aggregation method, and other publicly known methods. Especially, from the viewpoint of reduction in energy cost during production, it is preferred to adopt an emulsion polymerization aggregation method by performing an emulsion polymerization or a mini-emulsion polymerization using at least a specific monomer in an aqueous medium so as to prepare a fine particle including a binder resin that contains a specific polymer (hereinafter, also referred to as a "resin fine particle"), and aggregating and fusing the binder resin fine particles together with other toner particle components as necessary. Also, the method of producing a toner by a suspension polymerization method disclosed in Japanese Patent Application Laid-Open No. 2010-191043 may be preferably adopted.

In the emulsion polymerization aggregation method, the resin fine particle can also have a structure of containing two or more layers each including a resin that has a different composition. In this case, a multi-stage polymerization method can be adopted. In the multi-stage polymerization, in a dispersion liquid of a first resin fine particle prepared by an emulsion polymerization process (first stage polymerization) according to a method known per se in the art, a polymerization initiator and a polymerizable monomer are added, and this system is subjected to a polymerization process (second stage polymerization).

An example of the production process of the toner according to the present invention obtained by an emulsion polymerization aggregation method is shown below:

(1A) a resin fine particle polymerization step of acting in an aqueous medium a radical polymerization initiator to a specific monomer for forming a binder resin and, as necessary, another polymerizable monomer to obtain resin fine particles, (1B) a colorant fine particle dispersion liquid preparation step of preparing a dispersion liquid of fine particles by a colorant (hereinafter, also referred to as a "colorant fine particles") as necessary, (2) an association step of adding an aggregating agent in an aqueous medium with the resin fine particles and the colorant fine particles present therein, and developing salting-out while performing aggregation and fusion, to form an associated particle, (3) an aging step of controlling the shape of the associated particles thereby to form a toner, (4) a filtering and washing step of filtering off toner particles from the aqueous medium, and removing a surfactant or the like from the toner particles, (5) a drying process of drying the washed toner particles, and (6) an external additive addition step of adding an external additive to the dried toner particles.

Here, an "aqueous medium" refers to a medium including 50 to 100% by mass of water and 0 to 50% by mass of a water-soluble organic solvent. As examples of the water-soluble organic solvent, may be mentioned methanol, ethanol, isopropanol, butanol, acetone, methyl ethyl ketone, and tetrahydrofuran. An alcohol-based organic solvent which does not dissolve the obtained resin is preferably used. As examples of such an alcohol-based organic solvent, may be mentioned methanol, ethanol, isopropanol, and butanol.

As a method of containing a parting agent in a toner particle, may be mentioned a method of configuring resin fine particles so as to contain a parting agent. As another method, may be mentioned a method of adding a dispersion liquid in which parting agent fine particles are dispersed in an aqueous medium in an association step of forming a toner particle, to salt out, aggregate and fuse resin fine particles, colorant fine particles, and parting agent fine particles. These methods may be combined.

Also, as a method of containing a charge control agent in a toner particle, may be mentioned a method similar to the above-described method of containing a parting agent.

(1A) Resin Fine Particle Polymerization Step:

This resin fine particle polymerization step includes, specifically, for example, adding a specific monomer and, as necessary, another polymerizable monomer in an aqueous medium; giving a mechanical energy for dispersion to form an oil drop; and, in this state, subjecting the specific monomer to a radical polymerization reaction, to thereby forming resin fine particles having a size of approximately 50 to 300 nm in terms of a volume-based median diameter, for example.

A dispersing apparatus for giving a mechanical energy so as to form an oil drop should not be particularly limited. As an exemplary dispersing apparatus, may be mentioned a commercially available stirrer "CLEAR MIX" (manufactured by M Technique Co., Ltd.) equipped with a rotor that rotates at high speed. Other than the foregoing stirrer equipped with a rotor capable of rotating at high speed, an apparatus such as an ultrasonic dispersion apparatus, a mechanical homogenizer, a Manton-Gaulin, and a pressure-type homogenizer may be used.

The temperature associated with a radical polymerization reaction varies depending on a type of a monomer and a radical polymerization initiator used. For example, the temperature is preferably 50 to 100° C., more preferably 55 to 90° C. Also, the time taken for a radical polymerization reaction varies depending on a type of a used monomer and a reaction rate of a radical from a radical polymerization initiator. For example, the time is preferably 2 to 12 hours.

Dispersion Stabilizer:

In the resin fine particle polymerization step, a dispersion stabilizer can be appropriately added in order to stably disperse fine particles in an aqueous medium.

As examples of the dispersion stabilizer, may be mentioned tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Also, a substance commonly used as a surfactant, such as polyvinyl alcohol, gelatine, methylcellulose, sodium dodecylbenzenesulfonate, ethylene oxide adducts, and higher alcohol sodium sulfate can also be used as a dispersion stabilizer.

As such a surfactant, may be used various publicly known ionic surfactants, nonionic surfactants and the like.

As examples of the ionic surfactant, may be mentioned sulfonic acid salts such as sodium dodecylbenzenesulfonate, sodium arylalkylpolyethersulfonate, sodium 3,3-disulfonediphenylurea-4,4-diazo-bis-amino-8-naphthol-6-sulfonate, ortho-carboxybenzene-azo-dimethylaniline, and sodium 2,2,5,5-tetramethyl-triphenylmethane-4,4-diazo-bis-β-naphthol-6-sulfonate; sulfuric ester salts such as sodium dodecyl sulfate, sodium tetradecyl sulfate, sodium pentadecyl sulfate, and sodium octyl sulfate, and fatty acid salts such as sodium oleate, sodium laurate, sodium caprate, sodium caprylate, sodium caproate, potassium stearate, and calcium oleate.

Also, as examples of the nonionic surfactant, may be mentioned polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, and sorbitan ester.

Polymerization Initiator:

As the polymerization initiator used in the resin fine particle polymerization step, may be used water-soluble polymerization initiators such as potassium persulfate, ammonium persulfate, and azobiscyanovaleric acid; water-soluble redox polymerization initiators such as hydrogen peroxide-ascorbic acid; and oil-soluble polymerization initiators such as azobisisobutyronitrile and azobisvaleronitrile.

Chain Transfer Agent:

In the resin fine particle polymerization step, a commonly used chain transfer agent can be used for the purpose of adjusting the molecular weights of a specific polymer. The chain transfer agent should not be particularly limited. Examples thereof may include n-octyl mercaptan, n-dodecyl mercaptan, tert-dodecyl mercaptan, and tetrachloromethane.

(1B) Colorant Fine Particle Dispersion Liquid Preparation Step:

This colorant fine particle dispersion liquid preparation step is performed as necessary when a toner particle containing a colorant is desired. In this step, a colorant is dispersed in a shape of fine particles in an aqueous medium to prepare a dispersion liquid of colorant fine particles.

Dispersion of a colorant may be performed by utilizing a mechanical energy.

The volume-based median diameter of colorant fine particles in a dispersed state is preferably 10 to 300 nm, more preferably 100 to 200 nm, particularly preferably 100 to 150 nm.

The volume-based median diameter of colorant fine particles is measured using an electrophoretic light scattering spectrophotometer "ELS-800" (manufactured by Otsuka Electronics Co., Ltd.).

With respect to (2) the association step to (6) the external additive addition step, the steps can be performed according to various publicly known processes.

Aggregating Agent:

Although the aggregating agent used in the association step should not be particularly limited, a substance selected from metal salts is suitably used. As examples of the metal salts, may be mentioned monovalent metal salts like alkali metal salts such as sodium, potassium, and lithium salts; divalent metal salts such as calcium, magnesium, manganese and copper salts; and trivalent metal salts such as iron and aluminum salts. As specific examples of the metal salts, may be mentioned sodium chloride, potassium chloride, lithium chloride, calcium chloride, magnesium chloride, zinc chloride, cooper sulfate, magnesium sulfate, and manganese sulfate. Among these, divalent metal salts are particularly preferably used, since aggregation can be developed with a small amount thereof. These may be used either singly or in any combination thereof.

External Additive:

The toner particle can constitute the toner according to the present invention as is. In order to improve fluidity, charging properties, cleaning properties and the like, the toner according to the present invention may be configured by adding in the toner particle an external additive such as a fluidizer and a cleaning auxiliary which are a so-called post-treatment agent.

As examples of the external additive, may be mentioned inorganic oxide fine particles such as silica fine particles, alumina fine particles, and titanium oxide fine particles; inorganic stearic acid compound fine particles such as aluminum stearate fine particles and zinc stearate fine particles; and inorganic titanic acid compound fine particles such as strontium titanate and zinc titanate. These may be used either singly or in any combination thereof.

These inorganic fine particles are preferably subjected to a surface treatment with a silane coupling agent, a titanium coupling agent, higher fatty acid, silicone oil and the like, in order to improve heat-resistant storage properties and environmental stability.

The total added amount of these various external additives is 0.05 to 5 parts by mass, preferably 0.1 to 3 parts by mass, per 100 parts by mass of the toner particles. Also, various external additives may be used in combination.

Developer:

The toner according to the present invention may be used as a magnetic or non-magnetic one-component developer as well as a two-component developer with a carrier mixed therein.

When the toner is used as a two-component developer, the mixed amount of the toner to a carrier is preferably 2 to 10% by mass.

A mixing device for mixing a toner and a carrier is not particularly limited. As examples of the mixing device, may be mentioned a Nauta mixer, and a W-cone or V-type mixer.

As the carrier, may be used magnetic particles made of conventionally known materials including: a metal such as iron, ferrite and magnetite; and an alloy of these metals and a metal such as aluminum and lead. Particularly, ferrite particles are preferred.

Also, as the carrier, may be used a coated carrier obtained by covering the surface of a magnetic particle with a coating agent such as a resin, or a binder-type carrier obtained by dispersing magnetic substance fine powder in a binder resin, and the like.

A covering resin constituting the coated carrier is not particularly limited. As examples thereof, may be mentioned olefin-based resins, styrene-based resins, styrene-acrylic-based resins, silicone-based resins, ester resins, and fluorine resins. Also, a resin constituting a resin dispersion type carrier is not particularly limited, and publicly known resins such as styrene-acrylic-based resins, polyester resins, fluorine resins, and phenol resins can be used.

The volume-based median diameter of a carrier is preferably 20 to 100 μm, more preferably 20 to 60 μm. A volume-based median diameter of a carrier can be typically measured using a laser diffraction particle size distribution analyzer "HELOS" (manufactured by Sympatec Co.) equipped with a wet disperser.

Image Formation Process:

The toner according to the present invention can be suitably used in an image formation process including a fixing step by a thermal pressure fixing system in which pressure and heat can be given at the same time. In particular, the toner can be suitably used in an image formation process in which a toner is fixed at a relatively low fixing temperature in a fixing step. In this case, the surface temperature of a heating member in a fixing nip part is 80 to 110° C., preferably 80 to 95° C.

Furthermore, the toner can be used in an image formation process of high speed fixing at a fixing linear speed of 200 to 600 mm/sec.

In this image formation process, specifically, the above-described toner is used to obtain a toner image by, for example, developing an electrostatic latent image formed on a photoreceptor. This toner image is transferred on an image support body. Thereafter, the toner image transferred on the image support body is fixed by a fixing treatment of a thermal pressure fixing system, thereby obtaining a printed matter with a visible image formed thereon.

Image Support Body:

As an image support body used in an image formation process in which the toner according to the present invention is used, may be specifically used coated printing paper such as plain paper, high quality paper, art paper, and coated paper with a thickness of from thin to thick, and a variety of printing paper such as commercially available Japanese paper and postcard paper, for example, although the present invention is not limited thereto.

In the above, the embodiments of the present invention have been specifically described. However, embodiments of the present invention should not be limited to the above-described examples, and various modifications can be made thereto.

EXAMPLES

Although specific examples of the present invention will be described below, the present invention shall not be limited to these examples.

Specific Monomer Synthesis Example 1

In a solution of L-phenylalanine (16.5 g, 100 mmol) and triethylamine (29.2 ml, 210 mmol) in methylene chloride (200 ml), methacryloyl chloride (8.5 ml, 105 mmol) was dropwisely added under a nitrogen gas stream at 0° C., and stirred at room temperature for one day. The reaction mixture was washed with 1N—HCl (200 ml×2), a saturated $NaHCO_3$ aqueous solution (200 ml×1) and saturated NaCl (200 ml×1). Thereafter, the mixture was dried with anhydrous $MgSO_4$, and filtered. The solvent of the filtrate was distilled away under reduced pressure to obtain a crude product. The obtained crude product was fractionated by silica gel column chromatography using an n-hexane/ethyl acetate mixed solution (from 4/1 to 2/1) as a developing solvent to obtain 13.3 g (yield 60%) of a specific monomer (1) (N-methacryloyl-L-phenylalanine (compound (1) above)).

Specific Monomer Synthesis Example 2

A specific monomer (2) (N-methacryloyl-L-phenylalanine methyl ester (compound (2) above)) (14.8 g (yield 60%)) was obtained in the same manner as in the specific monomer synthesis example 1, except that L-phenylalanine methyl ester hydrochloride (21.6 g, 100 mmol) was used instead of L-phenylalanine.

Specific Monomer Synthesis Example 3

A specific monomer (3) (N-methacryloyl-L-tyrosine (compound (3) above)) (18.0 g (yield 75%)) was obtained in the same manner as in the specific monomer synthesis example 1, except that L-tyrosine (18.2 g, 100 mmol) was used instead of L-phenylalanine.

Specific Monomer Synthesis Example 4

A specific monomer (4) (3,4-dihydroxy-N-methacryloyl-L-phenylalanine (compound (4) above) (20.5 g (yield 80%)) was obtained in the same manner as in the specific monomer synthesis example 1, expect that L-DOPA (19.9 g, 100 mmol) was used instead of L-phenylalanine.

Toner Production Example 1

(1) Polymerization of Resin Fine Particle (a) First Stage Polymerization:

Using a mechanical disperser "CLEAR MIX" (manufactured by M Technique Co., Ltd.), a monomer mixed liquid including 560 parts by mass of the specific monomer (1), 240 parts by mass of butyl acrylate, and 68 parts by mass of methacrylic acid was mixed and dispersed for one hour. Thus, an emulsified dispersion liquid [1a] containing emulsified particles was prepared.

In a reaction vessel equipped with a stirrer, a temperature sensor, a condenser, and a nitrogen-introducing device, a surfactant solution of 4 parts by mass of sodium polyoxyethylene(2)dodecyl ether sulfate dissolved in 3000 parts by mass of ion exchanged water was charged. The internal temperature of the solution was increased to 80° C. while stirring the solution at a stirring speed of 230 rpm under a nitrogen gas stream.

Into the surfactant solution, an initiator solution of 5 parts by mass of a polymerization initiator (potassium persulfate: KPS) dissolved in 200 parts by mass of ion exchanged water was added, and the liquid temperature was set at 75° C. Thereafter, the emulsified dispersion liquid [1a] was dropwisely added for one hour. This system was heated and stirred at 75° C. for 2 hours to perform polymerization, thereby preparing a resin fine particle dispersion liquid [1a].

(b) Second Stage Polymerization:

Using a mechanical dispenser "CLEAR MIX" (manufactured by M Technique Co., Ltd.), a monomer mixed liquid including 132 parts by mass of the specific monomer (1), 57 parts by mass of butyl acrylate, 20 parts by mass of methacrylic acid, 0.5 parts by mass of n-octyl mercaptan, and 82 parts by mass of "WEP-5" (manufactured by Nippon Oil & Fats Co., Ltd.) was mixed and dispersed for one hour. Thus, an emulsified dispersion liquid [1b] containing emulsified particles was prepared.

In a reaction vessel equipped with a stirrer, a temperature sensor, a condenser, and a nitrogen-introducing device, a surfactant solution of 2 parts by mass of sodium polyoxyethylene(2)dodecyl ether sulfate dissolved in 1270 parts by mass of ion exchanged water was charged, and the temperature was increased to 80° C. Thereafter, 40 parts by mass based on a solid content of the resin fine particle dispersion liquid [1a] was added. Furthermore, after the liquid temperature was controlled at 80° C., the emulsified dispersion liquid [1b] was added. In the mixture, an initiator solution of 5 parts by mass of a polymerization initiator (potassium persulfate: KPS) dissolved in 100 parts by mass of ion exchanged water was added. This system was heated and stirred at 80° C. for one hour to perform polymerization, thereby preparing a resin fine particle dispersion liquid [1].

(2) Preparation of Colorant Fine Particle Dispersion Liquid

While a solution of 27 parts by mass of sodium n-dodecyl sulfate added in 500 parts by mass of ion exchanged water was stirred, 30 parts by mass of carbon black as a colorant was gradually added. Next, a dispersion treatment was performed using a mechanical disperser "CLEAR MIX" (manufactured by M Technique Co., Ltd.), thereby preparing a colorant fine particle dispersion liquid [1].

(3) Formation of Toner Particles 1250 parts by mass of the resin fine particle dispersion liquid [1], 2000 parts by mass of ion exchanged water, and 165 parts by mass of the colorant fine particle dispersion liquid [1] were placed in a reaction vessel equipped with a temperature sensor, a condenser, a nitrogen-introducing device, and a stirrer, and stirred to prepare a solution for association. After the internal temperature of this solution for association was adjusted at 30° C., 5 mol/L of an aqueous sodium hydroxide solution was added to adjust its pH at 10.0. Next, an aqueous solution of 52.6 parts by mass of magnesium chloride hexahydrate dissolved in 72 parts by mass of ion exchanged water was added under stirring at 30° C. for 10 minutes. After the product was left to stand for 3 minutes, temperature rise started, and the temperature of this system was increased for 6 minutes to 90° C. (temperature rise rate=10° C./min).

In this state, the average particle diameter of associated particles was measured by "Multisizer 3" (manufactured by Beckman Coulter, Inc.). When the volume-based median diameter reached 6.7 μm, an aqueous solution of 115 parts by mass of sodium chloride dissolved in 700 parts by mass of ion exchanged water was added to stop the growth of particles. Furthermore, heating and stirring were performed at a liquid temperature of 90° C.±2° C. for 6 hours to continue fusion. The roundnesses of these associated particles were measured by "FPIA 2100" (manufactured by Sysmex Corporation), and the average roundness was found to be 0.958.

Next, cooling was performed to 30° C. under the condition of 6° C./min, and the associated particles were filtrated. The particles were repeatedly washed with ion exchanged water at 45° C., and then dried with hot air at 40° C., thereby obtaining a toner particle [1].

(4) Addition of External Additive

Per 100 parts by mass of the toner particle [1], an external additive including 1.0 part by mass of silica (average primary particle size: 12 nm, hydrophobization degree: 68) treated with hexamethylsilazane and 0.3 parts by mass of titanium dioxide (average primary particle size: 20 nm, hydrophobization degree: 63) treated with n-octyl silane was added. An external addition treatment was performed using a "Henschel mixer" (manufactured by Mitsui-Miike Mining Co., Ltd.) to produce a black toner [1].

In this case, the external addition treatment by a Henschel mixer was performed under the condition of a peripheral speed of a stirring blade of 35 m/sec, a treatment temperature of 35° C., and a treatment time of 15 minutes.

Toner Production Examples 2 to 3

Toners [2] to [3] were produced in the same manner as in the toner production example 1, except that the added amounts of the specific monomer (1) and butyl acrylate (BA) were changed to the amounts shown in TABLE 1.

TABLE 1

| | First stage polymerization | | Second stage polymerization | | Copolymerization ratio (Ratio by mass) | |
|---|---|---|---|---|---|---|
| Toner No. | Specific monomer (1) (Parts by mass) | BA (Parts by mass) | Specific monomer (1) (Parts by mass) | BA (Parts by mass) | Specific monomer (1) | BA |
| [1] | 560 | 240 | 132 | 57 | 70 | 30 |
| [2] | 600 | 200 | 141 | 48 | 75 | 25 |
| [3] | 640 | 160 | 151 | 38 | 80 | 20 |

Toner Production Examples 1 to 6

Toners [4] to [6] were produced in the same manner as in the toner production example 1, except that the specific monomer (2) was used instead of the specific monomer (1), and the added amounts of the specific monomer (2) and butyl acrylate (BA) were changed to the amounts shown in TABLE 2.

TABLE 2

| | First stage polymerization | | Second stage polymerization | | Copolymerization ratio (Ratio by mass) | |
|---|---|---|---|---|---|---|
| Toner No. | Specific monomer (2) (Parts by mass) | BA (Parts by mass) | Specific monomer (2) (Parts by mass) | BA (Parts by mass) | Specific monomer (2) | BA |
| [4] | 640 | 160 | 151 | 38 | 80 | 20 |
| [5] | 704 | 96 | 166 | 23 | 88 | 12 |
| [6] | 752 | 48 | 177 | 11 | 94 | 6 |

Toner Production Examples 7 to 9

Toners [7] to [9] were produced in the same manner as in the toner production example 1, except that the specific monomer (3) was used instead of the specific monomer (1), and the added amounts of the specific monomer (3) and butyl acrylate (BA) were changed to the amounts shown in TABLE 3.

TABLE 3

| | First stage polymerization | | Second stage polymerization | | Copolymerization ratio (Ratio by mass) | |
|---|---|---|---|---|---|---|
| Toner No. | Specific monomer (3) (Parts by mass) | BA (Parts by mass) | Specific monomer (3) (Parts by mass) | BA (Parts by mass) | Specific monomer (3) | BA |
| [7] | 512 | 288 | 121 | 68 | 64 | 36 |
| [8] | 544 | 256 | 128 | 61 | 68 | 32 |
| [9] | 584 | 216 | 138 | 51 | 73 | 27 |

Toner Production Examples 10 to 12

Toners [10] to [12] were produced in the same manner as in the toner production example 1, except that the specific monomer (4) was used instead of the specific monomer (1), and the added amounts of the specific monomer (4) and butyl acrylate (BA) were chanced to the amounts shown in TABLE 4.

TABLE 4

| | First stage polymerization | | Second stage polymerization | | Copolymerization ratio (Ratio by mass) | |
|---|---|---|---|---|---|---|
| Toner No. | Specific monomer (4) (Parts by mass) | BA (Parts by mass) | Specific monomer (4) (Parts by mass) | BA (Parts by mass) | Specific monomer (4) | BA |
| [10] | 480 | 320 | 113 | 76 | 60 | 40 |
| [11] | 520 | 280 | 123 | 67 | 65 | 35 |
| [12] | 560 | 240 | 132 | 57 | 70 | 30 |

Toner Production Examples 13 to 16

Toners [13] to [16] were produced in the same manner as in the toner produced example 1, except that a specific monomer of a type shown in TABLE 5 was used instead of the specific monomer (1), styrene was a added, and the added amounts of the specific monomer, styrene, and butyl acrylate (BA) were changed to the amounts shown in TABLE 5.

TABLE 5

| Toner No. | Type of monomer | First stage polymerization: Specific monomer (Parts by mass) | First stage polymerization: Styrene (Parts by mass) | First stage polymerization: BA (Parts by mass) | Second stage polymerization: Specific monomer (Parts by mass) | Second stage polymerization: Styrene (Parts by mass) | Second stage polymerization: BA (Parts by mass) | Copolymerization ratio (Ratio by mass): Specific monomer | Copolymerization ratio (Ratio by mass): Styrene | Copolymerization ratio (Ratio by mass): BA |
|---|---|---|---|---|---|---|---|---|---|---|
| [13] | Specific monomer (1) | 400 | 200 | 200 | 94 | 47 | 48 | 50 | 25 | 25 |
| [14] | Specific monomer (2) | 400 | 264 | 136 | 94 | 62 | 32 | 50 | 33 | 17 |
| [15] | Specific monomer (3) | 400 | 160 | 240 | 94 | 38 | 57 | 50 | 20 | 30 |
| [16] | Specific monomer (4) | 400 | 138 | 264 | 94 | 32 | 63 | 50 | 17 | 33 |

Measurement of Glass Transition Temperature:

The glass transition temperature (Tg) of each of the obtained toners [1] to [16] was measured using a differential scanning calorimeter "DSC-7" (manufactured by PerkinElmer, Inc.). The results are shown in TABLE 6.

Specifically, 4.5 mg of a measurement sample (a toner) is sealed in an aluminum pan "KIT No. 0219-0041," and the pan is set in a sample holder of "DSC-7." An empty aluminum pan was used for reference measurement. A measurement was performed under the condition of a measurement temperature of 0° C. to 200° C., a temperature rise rate of 10° C./min, a temperature drop rate of 10° C./min, and Heat-cool-Heat temperature control. An analysis was performed based on the data of the 2nd. Heat. As to the glass transition temperature, an extension line of a base line before rising of the first endothermic peak and a tangent line indicating a maximum inclination in the range from a rising part to a peak top of the first endothermic peak are drawn. Then, an intersection point therebetween is shown as a glass transition temperature. In this case, during the 1st. Heat temperature rise, 200° C. was maintained for 5 minutes.

Developer Preparation Examples 1 to 16

A ferrite carrier that was coated with a silicone resin and had a volume average median diameter of 60 μm was mixed to each of Toners [1] to [16] using a V-shaped mixer so as to achieve a toner concentration of 6% by mass, thereby producing developers [1] to [16].

Examples 1 to 16

(1) Evaluation of Low Temperature Fixability

A commercially available copying machine "bizhub Pro C6500" (manufactured by Konica Minolta Business Technologies, Inc.) was modified so that the surface temperature of a heating roller in a fixing device can be changed in steps of 5° C. in a range of 120 to 170° C. A developing device of the copying machine was charged with each of the developers [1] to [16]. In a fixing experiment, a solid image (toner attachment amount: 2.0 mg/cm$^2$) having a size of 1.5 cm×1.5 cm was fixed on an A4-sized high quality paper (64 g/m$^2$) in a normal temperature and normal humidity (temperature 20° C., humidity 55% RH) environment. This fixing experiment was repeatedly performed by changing the fixing temperature (the surface temperature of the heating roller) to be set in increments of 5° C. at 120° C., 125° C., and so on.

The solid image obtained in each fixing experiment was folded in half along the middle portion, and peeling properties of the image were visually observed. The lowest fixing temperature in the fixing experiment in which no peeling of an image was observed was determined to be a fixing lower limit temperature. When this fixing lower limit temperature is lower than 150° C., there is no practical problem, and a judgment is made to be acceptable. The results are shown in TABLE 6.

(2) Evaluation of Charging Properties

Each of the developers [1] to [16] was left to stand for 10 hours in a low temperature and low humidity environment (temperature 10° C., humidity 20% RH) and in a high temperature and high humidity environment (temperature 30° C., humidity 80% RH). Thereafter, the charge amount of each developer was measured by an electric field separation method below. When the difference between the low temperature and low humidity environment and the high temperature and high humidity environment is not larger than 10 μC/g, a judgment is made to be acceptable. The results are shown in TABLE 6.

A measurement of a charge amount by an electric field separation method is performed by a procedure below.

(1) A developer (30 g) is placed in a 50 ml polyethylene bottle, and the polyethylene bottle is rotated at 120 rpm for 20 minutes.

(2) The developer (1 g) from the above-described polyethylene bottle is set on a magnet roller, and counter electrodes which have been previously measured in mass are set.

(3) A bias of 1 kV is applied with the same polarity as the toner polarity, and in this state, the magnet roller is rotated at 500 rpm for one minute.

(4) After the rotation of the above-described magnet roller is completed, the voltage between the counter electrodes and the mass thereof are measured. Based on the mass M (g) of the toner attached to the counter electrodes, and product Q of condenser capacity (here, 1 μF) and voltage V between the counter electrodes, toner charge amount Q/M (μC/g) is calculated.

(3) Evaluation of Images

A developing device of a commercially available copying machine "bizhub Pro C6500" (manufactured by Konica Minolta Business Technologies, Inc.) was charged with each of the developers [1] to [16]. An image was formed in a low temperature and low humidity environment (temperature 10° C., humidity 20% RH) and in a high temperature and high humidity environment (temperature 30° C., humidity 80% RH). With respect to the obtained images, dot reproducibility and fine line reproducibility, as well as image density were evaluated as in a manner described below. The results are shown in TABLE 6.

(3-1) Dot Reproducibility and Fine Line Reproducibility:

A dot image at 1200 dpi and a fine line image with 5 vertical and horizontal lines/mm were formed on an A4-sized high quality paper (64 g/m$^2$), and visually inspected in accordance with evaluation criteria below.

—Evaluation Criteria—

A: Significantly excellent in both dot reproducibility and fine line reproducibility B: Excellent in both dot reproducibility and fine line reproducibility C: Reduced dot reproducibility or fine line reproducibility, without practical problems D: Reduced dot reproducibility or fine line reproducibility, with practical problems (3-2) Image Density:

A solid black image was formed on an A4-sized high quality paper (64 g/m$^2$). Then, the density on the solid black image was randomly measured at 5 locations using a densitometer manufactured by Macbeth. The average density thereof was calculated. When the average density is not lower than 1.30 and the difference between the low temperature and low humidity environment and the high temperature and high humidity environment is not larger than 0.05, a judgment is made to be acceptable.

TABLE 6

| | | | Evaluation | | | | | | | | |
|---|---|---|---|---|---|---|---|---|---|---|---|
| | | | | Charging property | | | Dots/Fine line reproducibility | | Image density | | |
| | Developer No. | Tg of toner (° C.) | Low temperature fixability (° C.) | Low temperature and low humidity (μC/g) | High temperature and high humidity (μC/g) | Difference | Low temperature and low humidity | High temperature and high humidity | Low temperature and low humidity | High temperature and high humidity | Difference |
| Example 1 | [1] | 44 | 125 | 42.8 | 40.8 | 2.0 | A | B | 1.52 | 1.55 | 0.03 |
| Example 2 | [2] | 54 | 125 | 43.8 | 40.5 | 1.9 | A | B | 1.55 | 1.56 | 0.01 |
| Example 3 | [3] | 66 | 130 | 43.5 | 41.3 | 2.2 | A | A | 1.51 | 1.53 | 0.02 |
| Example 4 | [4] | 41 | 125 | 44.4 | 41.1 | 3.3 | A | B | 1.50 | 1.52 | 0.02 |
| Example 5 | [5] | 56 | 130 | 43.5 | 40.3 | 3.2 | A | A | 1.48 | 1.50 | 0.02 |
| Example 6 | [6] | 67 | 130 | 43.6 | 40.9 | 2.7 | A | A | 1.51 | 1.53 | 0.02 |
| Example 7 | [7] | 44 | 125 | 42.4 | 41.5 | 0.9 | A | A | 1.48 | 1.51 | 0.03 |
| Example 8 | [8] | 53 | 125 | 43.0 | 41.7 | 1.3 | A | A | 1.50 | 1.53 | 0.03 |
| Example 9 | [9] | 66 | 130 | 42.8 | 40.9 | 1.9 | A | A | 1.51 | 1.66 | 0.04 |
| Example 10 | [10] | 44 | 120 | 43.0 | 41.2 | 1.8 | A | A | 1.51 | 1.54 | 0.03 |
| Example 11 | [11] | 56 | 120 | 44.0 | 42.0 | 2.0 | A | A | 1.51 | 1.53 | 0.02 |
| Example 12 | [12] | 69 | 125 | 43.5 | 41.1 | 2.4 | A | A | 1.50 | 1.52 | 0.02 |
| Example 13 | [13] | 51 | 125 | 42.0 | 40.0 | 2.0 | A | A | 1.52 | 1.55 | 0.03 |
| Example 14 | [14] | 52 | 125 | 42.4 | 40.1 | 2.3 | A | A | 1.50 | 1.52 | 0.02 |
| Example 15 | [15] | 51 | 125 | 43.0 | 41.5 | 1.5 | A | A | 1.48 | 1.50 | 0.01 |
| Example 16 | [16] | 52 | 120 | 43.3 | 42.1 | 1.2 | A | A | 1.52 | 1.55 | 0.03 |

From the above results, according to the toners in Examples 1 to 16 of the present invention, it was confirmed that, since the polymerizable monomer represented by the general formula (1) is used as a monomer for forming the binder resin, an environment variation difference in a charging ability can be controlled to be small while having sufficient low temperature fixability, so that a high quality image can be formed. It was also confirmed that the balance between low temperature fixability and a charging ability is particularly favorable in the toners of Examples 1, 7, 8, and 10 to 16 wherein the content (copolymerization ratio) of the polymerizable monomer represented by the general formula (1) is 27 to 70% by mass.

The invention claimed is:

1. A toner for developing an electrostatic image, comprising toner particles containing at least a binder resin, wherein the binder resin contains a polymer prepared by polymerizing a polymerizable monomer represented by a following general formula (1):

General Formula (1)

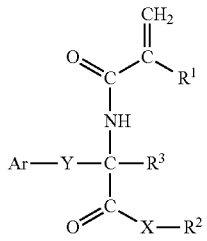

wherein in the general formula (1), $R^1$ and $R^2$ each independently represent a hydrogen atom, or a substituted or unsubstituted alkyl group having 1 to 2 carbon atoms; $R^3$ represents a hydrogen atom, or a substituted or unsubstituted alkyl group having 1 to 4 carbon atoms; X represents an oxygen atom or a single bond; Y represents a substituted or unsubstituted alkylene group having 1 to 4 carbon atoms, or a single bond; and Ar represents a substituted or unsubstituted aryl group.

2. The toner for developing an electrostatic image according to claim 1, wherein Ar in the general formula (1) is a group represented by a following general formula (2):

General Formula 2

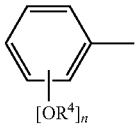

wherein in the general formula (2), $R^4$ represents a hydrogen atom, or a substituted or unsubstituted alkyl group having 1 to 4 carbon atoms; n is an integer of 0 to 3; when n is an integer of 2 or 3, a plurality of $R^4$s may be the same or different.

3. The toner for developing an electrostatic image according to claim 2, wherein $R^4$ in the general formula (2) is a hydrogen atom.

4. The toner for developing an electrostatic image according to claim 1, wherein the polymer is prepared by copolymerizing the polymerizable monomer represented by the general formula (1) and (meth)acrylic ester.

5. The toner for developing an electrostatic image according to claim 1, wherein the polymer is prepared by copolymerizing the polymerizable monomer represented by the general formula (1), (meth)acrylic ester, and styrene.

6. The toner for developing an electrostatic image according to claim 1, wherein a content of the polymerizable monomer represented by the general formula (1) is 27 to 70% by mass per a total amount of monomers for forming the polymer.

* * * * *